US005468934A

United States Patent [19]

Anthony et al.

[11] Patent Number: 5,468,934

[45] Date of Patent: Nov. 21, 1995

[54] APPARATUS FOR ANNEALING DIAMOND WATER JET MIXING TUBES

[75] Inventors: Thomas R. Anthony, Niskayuna; James F. Fleischer, Scotia, both of N.Y.

[73] Assignee: General Electric Company, Schenectady, N.Y.

[21] Appl. No.: 267,181

[22] Filed: Jun. 15, 1994

[51] Int. Cl.[6] ..... F27B 5/16

[52] U.S. Cl. ..... 219/390; 219/383; 427/249

[58] Field of Search ..... 219/383, 385, 219/390–392, 608, 614, 615; 228/144; 118/719; 266/250, 252, 255; 29/890.142; 427/237, 249; 423/446

[56] References Cited

U.S. PATENT DOCUMENTS

| | | | |
|---|---|---|---|
| 4,707,384 | 11/1987 | Schachner et al. | 427/249 |
| 4,912,302 | 2/1990 | Kobayashi et al. | 219/390 |
| 5,001,327 | 3/1991 | Hirasawa et al. | 219/390 |
| 5,363,556 | 11/1994 | Banholzer et al. | 29/890.142 |

*Primary Examiner*—Tu Hoang
*Attorney, Agent, or Firm*—William H. Pittman

[57] ABSTRACT

An apparatus for annealing diamond water jet mixing tubes comprises an enclosure, a vertical cylindrical heating tube in the enclosure, a heater for the heating tube and a rack in the heating tube to support the diamond mixing tube. Annealing relieves internal tensile stresses which can decrease the life of the mixing tube.

6 Claims, 1 Drawing Sheet

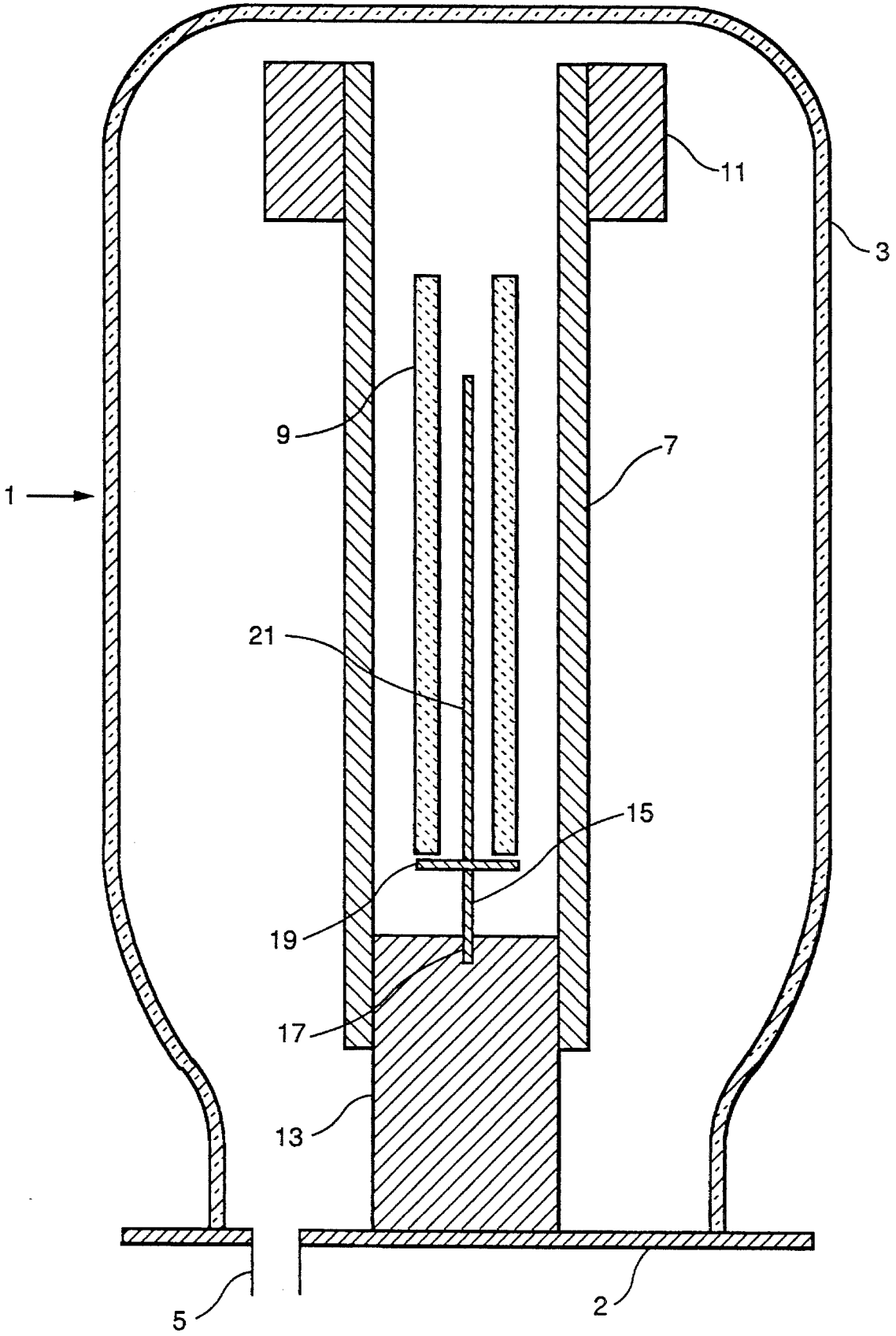
11
3
9
7
1
21
15
19
17
13
5
2

APPARATUS FOR ANNEALING DIAMOND WATER JET MIXING TUBES

BACKGROUND OF THE INVENTION

This invention relates to the fabrication of diamond water jet mixing tubes, and more particularly to the annealing of such tubes.

The fabrication of diamond articles, including mixing tubes, by chemical vapor deposition (hereinafter "CVD") is known in the art. CVD methods for diamond involve the thermal activation of a mixture of elemental hydrogen and a hydrocarbon gas at relatively low pressure in contact with a substrate. Illustrative methods of activation include the use of a heated filament and the use of radiational methods, such as microwaves. The gas is converted upon activation to molecular species which deposit on the substrate in the form of diamond. In the case of a mixing tube, the substrate is subsequently etched away.

Typical substrate temperatures for diamond deposition are in the range of 750°–900° C. At these temperatures, diamond is brittle and plastic flow thereof does not occur. One result is that the diamond is subject to large intrinsic tensile stresses, both circumferential and longitudinal, which cannot relax. The existence of such stresses is shown by polarized optical transmission microscopy and can be demonstrated by cutting a tube in half longitudinally, whereupon each half relaxes into a banana peel shape to relieve the stresses.

One possible result of such stresses in diamond jet mixing tubes is their erratic performance in use. The abrasive jet which passes through the tube often perforates its side wall at a midtube location where a minimum amount of wear would be expected. The exit nozzle, on the other hand, may demonstrate long life. This phenomenon is indicative of tube failure being caused by intrinsic deposition stresses, since such stresses are at a maximum at the midtube position. Their elimination or diminution, therefore, would be expected to add significantly to the life of the mixing tube and would eliminate the need for metal reinforcing jackets, presently deposited on such mixing tubes by expensive, cumbersome methods such as plasma deposition.

Copending, commonly owned application Ser. No. 08/238,544 discloses the annealing of diamond articles at high pressure to relax these stresses. Applications Ser. Nos. 08/238,543 and 08/238,545 describes low pressure annealing methods. All of these methods typically employ temperatures in the range of about 1100°–2200° C., and the low pressure methods typically also require a non-oxidizing atmosphere to suppress conversion of the diamond to graphite.

This annealing operation facilitates plastic flow of the diamond which in turn relieves the stresses in the diamond article. However, equipment which permits the annealing of water jet mixing tubes, and particularly high temperature annealing thereof, is not presently available.

SUMMARY OF INVENTION

The present invention is directed to apparatus which makes possible low temperature annealing of mixing tubes. Said apparatus includes means for supporting an annealing tube in a non-oxidizing atmosphere and heating it under hydrostatic conditions so as to relieve stresses without introducing further stresses.

Therefore, the invention is apparatus for annealing diamond water jet mixing tubes, comprising:

- an enclosure having means for charging a gas to a pressure up to about 5 atmospheres;
- a cylindrical heating tube positioned vertically in said enclosure, said tube being of a refractory metal and having an upper end, a lower end and a length effective to avoid large thermal gradients in the area surrounding a diamond mixing tube to be annealed therein;
- heating means for isothermally heating said heating tube to a temperature in the range of about 1100°–2000° C.;
- a rack centered horizontally in said heating tube and fixed to said lower electrode, said rack being of a refractory material and comprising a vertical rod and a horizontal support fixed to said vertical rod, said support being of a size to support said mixing tube and being spaced from said lower electrode at a distance such that said mixing tube is contained entirely within and vertically centered in said heating tube.

BRIEF DESCRIPTION OF THE DRAWING

The drawing is a cross-sectional view, on the vertical center plane, of apparatus according to the invention.

DETAILED DESCRIPTION; PREFERRED EMBODIMENT

Reference is made to the drawing in which an enclosure 1 is formed by a flat base 2 and dome 3 forming a seal therewith. Inlet 5 permits bringing the enclosure to a suitable pressure, which may be high vacuum (e.g., less than about 1 torr), or, alternatively, a pressure of about 1 torr to several atmospheres of a non-oxidizing gas to a pressure from about 1 torr to about 5 atmospheres; pressures up to about 10 torr are usually preferred. Illustrative non-oxidizing gases include hydrogen, argon, neon, helium and nitrogen. Hydrogen is often preferred because of its particular effectiveness to suppress graphitization of the diamond tube.

Cylindrical heating tube 7 is positioned vertically in said enclosure. It is of a refractory metal such as molybdenum, tungsten, tantalum, titanium or niobium, preferably tantalum.

It is important for heating tube 7 to be of sufficient length to avoid large thermal gradients in the area surrounding diamond mixing tube 9 contained therein. The preferred minimum length therefor is the sum of the length and six times the diameter of said mixing tube.

Heating tube 7 is equipped with heating means, shown as comprising annular upper electrode 11 and cylindrical lower electrode 13 which form part of a conventional resistance heating circuit 12. Upper electrode 11 has a diameter to snugly and slidably enclose the upper end of heating tube 7, but to allow linear expansion of said heating tube when the temperature of the system is increased. Cylindrical lower electrode 13 fits snugly and slidably into the lower end of heating tube 7. Said electrodes are also normally of refractory metal, preferably molybdenum.

The apparatus of the invention also includes a rack centered horizontally in heating tube 7. Said rack is also of a refractory metal with the proviso that said metal should not soften at the temperatures attained within the heating tube; tungsten is preferred. As shown, said rack comprises vertical rod 15 supported by placement in hole 17 in lower electrode 13 and including an upper portion 21, and horizontal support 19 of a size to support diamond mixing tube 9 which surrounds upper portion 21 of the vertical rod. Support 19 is spaced from lower electrode 13 at a distance such that mixing tube 9 is contained entirely within and is vertically centered in heating tube 7.

To prepare the apparatus for operation, dome 3 is removed from base 2 and upper electrode 11, heating tube 7 and lower electrode 13 are disassembled. The diamond mixing tube 9 to be annealed is placed over upper portion 21 of rod 15 and lowered until it is supported by horizontal support 19. Heating tube 7 and electrodes 11 and 13 are then reassembled and dome 3 is positioned on base 2.

The desired atmosphere is established in enclosure 1. As previously mentioned, it may be high vacuum or a non-oxidizing gas atmosphere at a pressure from about 1 torr to several atmospheres. The necessary electrical connections are then made between electrodes 11 and 13 and the resistance heating circuit, and heating tube 7 is raised to a temperature in the range of about 1100°–2000° C. and maintained at that temperature for a period sufficient to anneal diamond tube 9 without causing graphitization thereof. This time decreases with an increase in annealing temperature and is usually less than 10 minutes. Upon cooling and removal, said tube is much less subject to intrinsic tensile stress than before annealing, and a longer useful life can therefore be expected.

What is claimed is:

1. Apparatus for annealing diamond water jet mixing tubes, comprising:

an enclosure having means for charging a gas to a pressure up to about 5 atmospheres;

a cylindrical heating tube having a predetermined length and diameter positioned vertically in said enclosure, said tube being of a refractory metal and having an upper end, a lower end, a cylindrical wall and a length effective to avoid large thermal gradients in an area surrounding a diamond mixing tube to be annealed therein;

heating means for isothermally heating said heating tube to a temperature in the range of about 1100°–2000° C.;

a rack centered horizontally in and with respect to the wall of said heating tube and fixed to a rack base, said rack being of a refractory material and comprising a vertical rod and a horizontal support fixed to said vertical rod, said support being of a size to support said mixing tube and being spaced from said rack base at a distance such that said mixing tube is contained entirely within and vertically centered in said heating tube.

2. Apparatus according to claim 1 wherein the length of said heating tube is at least the sum of the length and six times the diameter of said mixing tube.

3. Apparatus according to claim 2 wherein said heating tube is of tantalum.

4. Apparatus according to claim 2 wherein said rack is of tungsten.

5. Apparatus according to claim 2 wherein said heating means comprises an annular upper electrode having a diameter to snugly and slidably enclose said upper end of said heating tube but to allow linear expansion of said heating tube, said rack base is a cylindrical lower electrode snugly and slidably fitted in the lower end of said heating tube, and said heating means further comprises means for applying an electrical potential to said upper and lower electrodes.

6. Apparatus according to claim 5 wherein said electrodes are of molybdenum.

* * * * *